United States Patent [19]

Watanabe et al.

[11] 4,446,594

[45] May 8, 1984

[54] UPRIGHT TYPE ELECTRIC CLEANER

[75] Inventors: Syuji Watanabe, Ibaraki; Yoshitaro Ishii; Masao Sunagawa, both of Hitachi, all of Japan

[73] Assignee: Hitachi, Ltd., Tokyo, Japan

[21] Appl. No.: 383,946

[22] Filed: Jun. 1, 1982

[30] Foreign Application Priority Data

Jun. 3, 1981 [JP] Japan ..... 56-84434

[51] Int. Cl.[3] ..... A47L 9/00

[52] U.S. Cl. ..... 15/323; 15/326; 15/333; 15/354; 15/361; 474/122

[58] Field of Search ..... 15/361, 354–356, 15/333, 359, 323, 326; 474/124, 122, 119

[56] References Cited

U.S. PATENT DOCUMENTS

| | | | |
|---|---|---|---|
| 909,439 | 1/1909 | Miller | 474/124 |
| 1,448,397 | 3/1923 | Friend | 15/354 |
| 2,682,680 | 7/1954 | Trimble | 474/122 X |
| 2,682,681 | 7/1954 | Balluff | 474/122 X |
| 2,734,219 | 2/1956 | Kaufman | 15/361 |
| 2,959,804 | 11/1960 | Faber | 15/323 X |
| 3,381,329 | 5/1968 | Wied | 15/323 X |
| 3,579,699 | 5/1971 | Balzer | 15/361 |
| 3,936,905 | 2/1976 | Stewart et al. | 15/354 X |

*Primary Examiner*—Chris K. Moore

*Attorney, Agent, or Firm*—Antonelli, Terry & Wands

[57] ABSTRACT

An upright type electric cleaner including a main body case (1) and a suction port body (1), wherein when the main body case is brought to an upright position as the machine is inoperative, a rotary brush extending downwardly from the bottom of the suction port body (1) is released from contact with the surface to be cleaned. The suction port body includes a single switching knob which, when manipulated, enables the speed of operation of the rotary brush and the distance between the rotary brush and the surface to be cleaned to be adjusted simultaneously. A part of exhaust air of the cleaner released through a blower is led through a sound absorbing duct located in a bag compartment into a cord reel chamber to thereby greatly reduce the noise level of exhaust and preventing cord overheating of a power cord of the cleaner.

5 Claims, 10 Drawing Figures

UPRIGHT TYPE ELECTRIC CLEANER

BACKGROUND OF THE INVENTION

This invention relates to upright type electric cleaners, and, more particularly, to an upright type electric cleaner in which the rotary brush extending from the bottom surface of the suction port body is released from a surface to be cleaned while the main body is located in an upright position on the suction port body.

Heretofore, in upright type electric cleaners in which the rotary brush actuated by a drive source is mounted in the suction port body and the main body pivotally connected to the suction port body can be cleaned against the suction port body, means have been provided in many of them for lifting thje rotary brush away from the floor in order not to damage the floor to be cleaned even if the rotary brush is operated with the main body being leaned against the suction port body. Such means have been several in type and have encountered some problems. One of them is that the construction is complex, and another lacks strength. In still another, although the construction is simple, difficulties are encountered in keeping the spacing between the rotary brush and the surface of the floor to be cleaned constant due to a difference in the angle of tilting of the main body during a cleaning operation.

In upright type electric cleaners of the prior art, no means have ever been provided for effecting the adjustments of the height of the bottom plate of the suction port body from the floor to be cleaned and the adjustments of the operating speed of the rotary brush by manipulating a single knob. It has been customary to use separate mechanisms for attaining the aforesaid ends, so that the cleaners have been inconvenient to operate and lacked simplicity of construction.

SUMMARY OF THE INVENTION

This invention has been developed for the purpose of obviating the aforesaid disadvantages of the prior art. Accordingly the invention has as its object the provision of an upright type electric cleaner provided with means for separating the rotary brush projecting portion of the suction port body from the surface to be cleaned when the main body stands upright on the suction port body and a mechanism for allowing the adjustments of height of the suction port body and speed of the rotary brush by manipulating a single knob.

The aforesaid object can be accomplished according to the invention by providing, in an upright type electric cleaning machine provided with a suction port body formed with an opening at its bottom portion for drawing dust by suction by actuation of a dust drawing operation section and having a rotary brush located in the opening for operation by means of a rotary brush drive section associated with the dust drawing operation section, a front wheel located in the vicinity of the opening for movement therethrough in and out of a bottom plate and rotatably supported by a crank axle, a main body case mounted on a suction port body substantially in an upright position and tiltable with respect to the suction port body, means positioned against a part of the axle for urging same to move downwardly while being in engagement with a lower end portion of the main body case, a drive pulley and an idling pulley arranged in parallel to each other and connected to the rotary brush connected to the rotary brush drive section through a belt, a belt switching forked arm for holding the belt between its branches, a height setting cam for setting a height at which the cam is positioned against the axle of the front wheel for adjusting height, the height setting cam being rotatably mounted, and a switching knob projecting outwardly and located on a slide base to enable the belt switching forked arm and the height setting cam to be actuated as the single switching knob is manipulated.

The above and further objects and novel features of the invention will more fully appear from the following detailed description of the invention when the same is read in connection with the accompanying drawings. It is to be expressly understood, however, that the drawings are for purpose of illustration only and are not intended as a definition of the limits of the invention.

BRIEF DESCRIPTION OF THE INVENTION

DETAILED DESCRIPTION OF THE PREFERRED EMBODIMENT

A preferred embodiment of the invention will be described by referring to the accompanying drawings.

Figure 1:
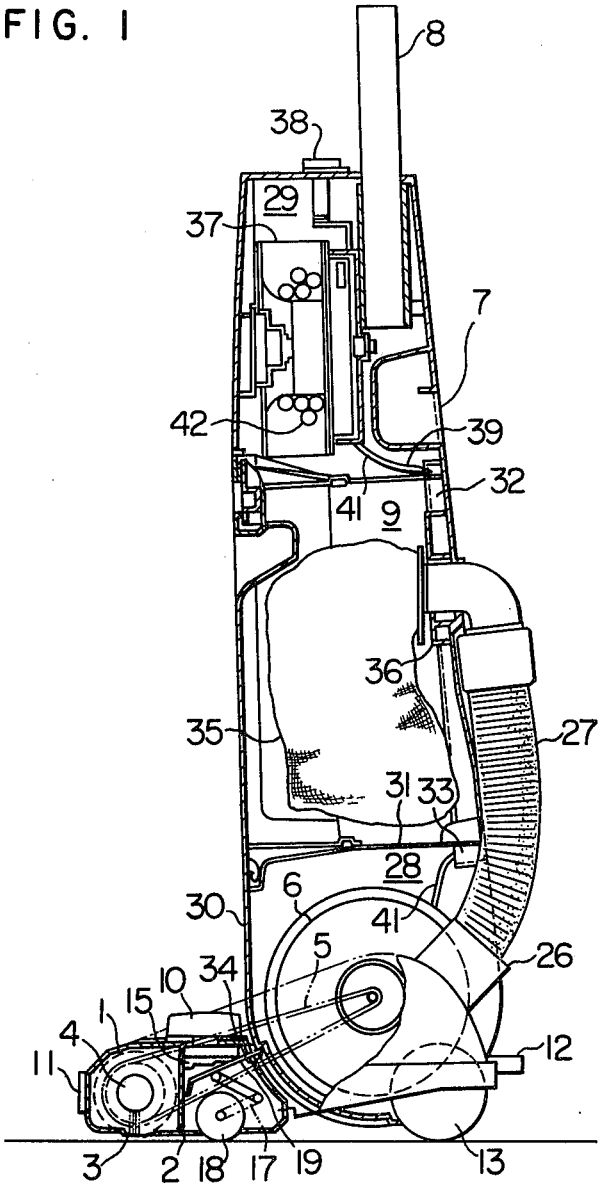
FIG. 1 is a vertical sectional view, with certain parts being broken away, of the upright type electric cleaner comprising one embodiment of the invention.

Referring to FIG. 1, a suction port body 1 includes a bottom plate 2 formed with an opening 3 which faces a part of a rotary brush 4. The rotary brush 4 is connected through a belt 5 to an electrically operated blower 6 constituting a dust drawing operation section to receive a supply of power therefrom to rotate the rotary brush 4.

Figure 2:
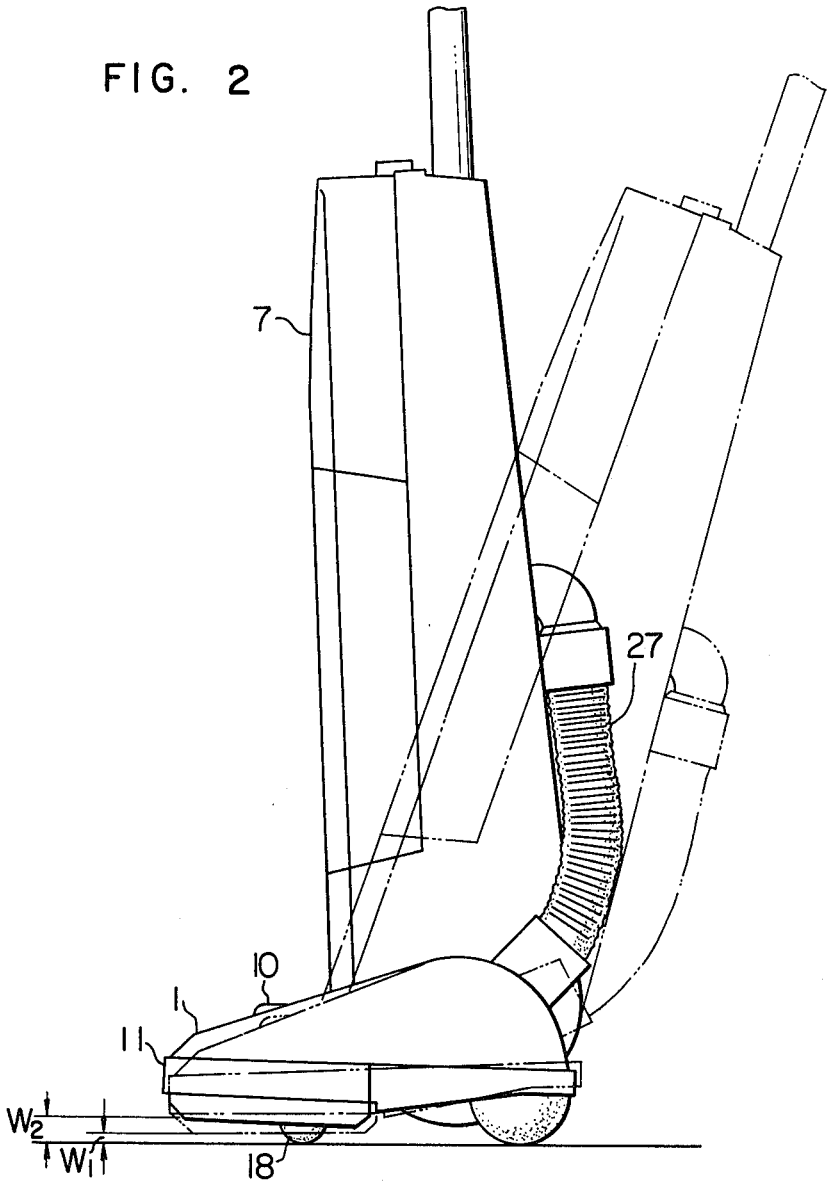
FIG. 2 is a view in explanation of the tilting of the main body case and the distance between the suction port bottom surface and the surface to be cleaned in the embodiment shown in FIG. 1.

A main body case 7 having a control handle 8 at its upper portion and a bag compartment 9 in the central portion is mounted for tilting movement as indicated by a solid line and a dash-and-dot line in FIG. 2 with respect to the suction port body 1 and constructed such that when inoperative the main body case 7 can stand in an upright position on the suction port body 1, as indicated by a solid line.

Referring to FIG. 2, $W_2$ designates a distance between the bottom plate 2 and the surface of the floor when the main body case 7 stands in an upright position, and $W_1$ designates a corresponding distance as measured when the machine is operative.

The suction port body 1 has attached to its outside a switching knob 10, a bumper 11 for absorbing shock to avoid damage that might otherwise be caused to furniture, etc., a pedal 12 operative to set up the main body case 7 on the suction port body 1 and a wheel 13.

The knob 10 is actuated for adjusting the distance between the bottom plate 2 of the suction port body 1 and the surface to be cleaned and the speed of the rotary brush 4 and for moving a floor brush 21 (see FIG. 5) in and out of the suction port body 1. The mechanism for effecting these adjustments and moving the floor brush 21 in and out of the suction port 1 is shown in FIGS. 3–8.

Figure 5:
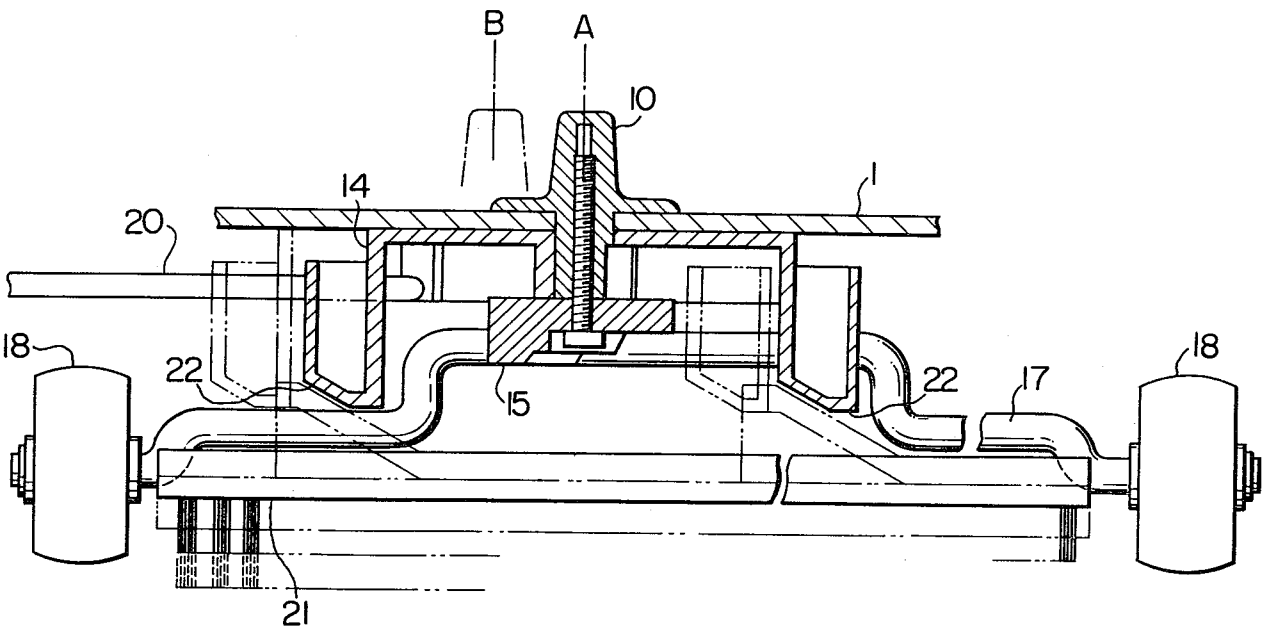
FIG. 5 is a sectional view, on an enlarged scale, of the switching knob of the embodiment shown in FIG. 1, showing its construction and operation.
Figure 6:
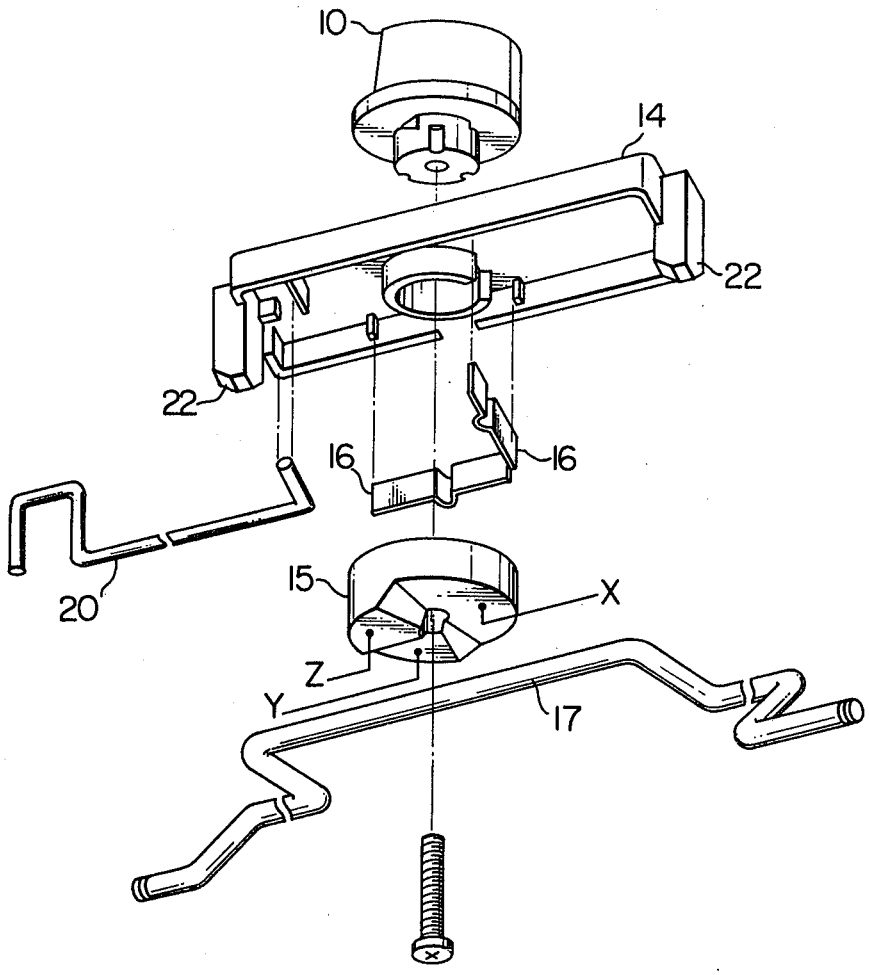
FIG. 6 is an exploded perspective view of the parts associated with the switching knob of the embodiment shown in FIG. 1.

As shown in FIGS. 5 and 6, the switching knob 10 is connected to a height setting cam 15 to form a unit which can rotated on a slide base 14. A knob positioning spring 16 is mounted as shown in FIG. 6 to enable the knob 10 to be locked in any desired position. The height setting cam 15 is divided substantially equally in a peripheral direction and provided with planes X, Y and Z different in level from one another so that each plane may be selectively positioned against an axle 17.

As shown in FIGS. 5 and 6, the slide base 14 has mounted thereon a belt switching forked arm 20 and a projection 22 for causing a floor brush 21 to move in and out which are linked to the movement of the slide base 14.

Figure 3:
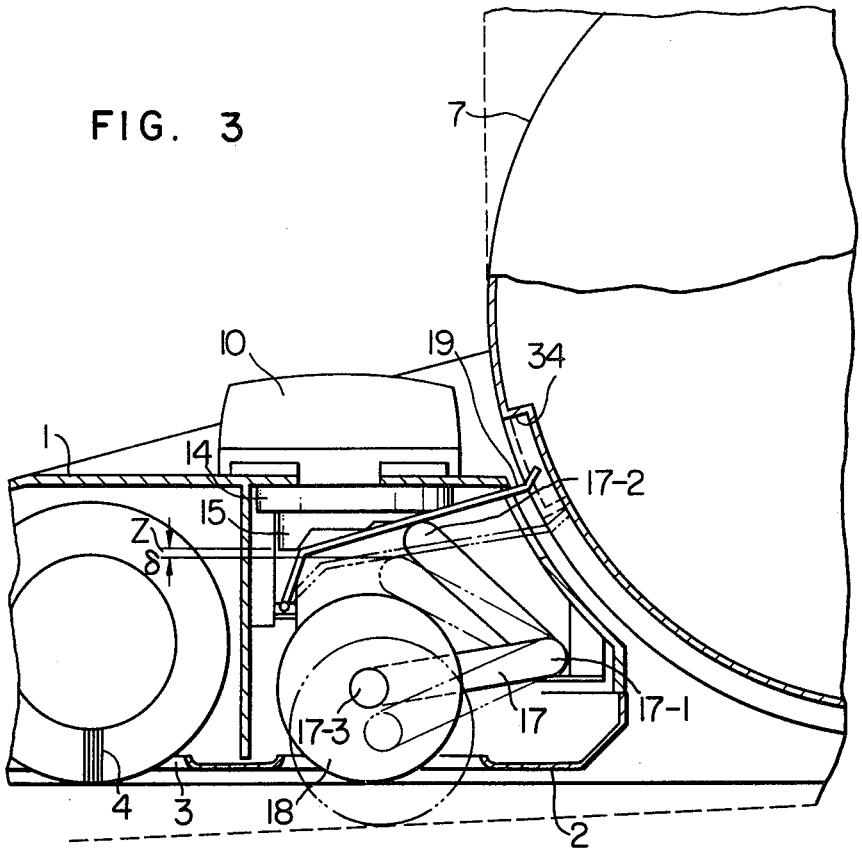
FIG. 3 is a sectional view, on an enlarged scale, of portions of the suction port of the embodiment shown in FIG. 1.
Figure 4:
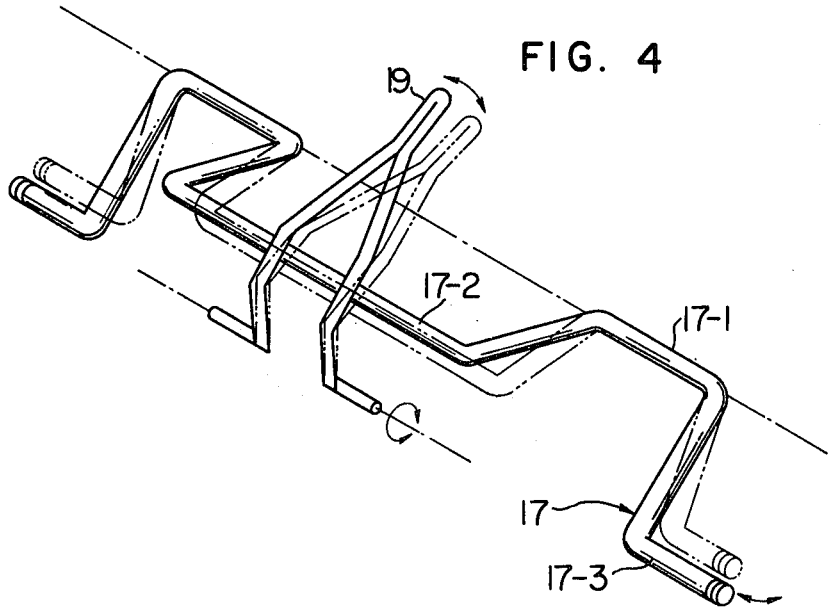
FIG. 4 is a perspective view of the height adjusting axle and the axle push-out lever of the embodiment shown in FIG. 1, showing their shapes and manner of operation.

As shown in FIG. 4, the axle 17 is in the form of a crank shaft and shaped like a letter V as viewed axially thereof as shown in FIG. 3. The axle 17 includes a central portion 17-1 supported by the suction port body 1 for rotary movement. An upper crank pin corresponding portion 17-2 is positioned against the height setting cam 15 as shown in FIGS. 3 and 5, and a lower crank pin corresponding portion 17-3 has attached thereto a front wheel 18 for adjusting height.

As shown in FIGS. 3 and 4, an axle push-out lever 19 pivotally connected at one end thereof to the suction port body 1 and engaged with the main body case 7 at the other outwardly projecting end thereof, contacts substantially at the central portion thereof with a part of the upper crank pin corresponding position 17-2 of the axle 17.

Figure 7:
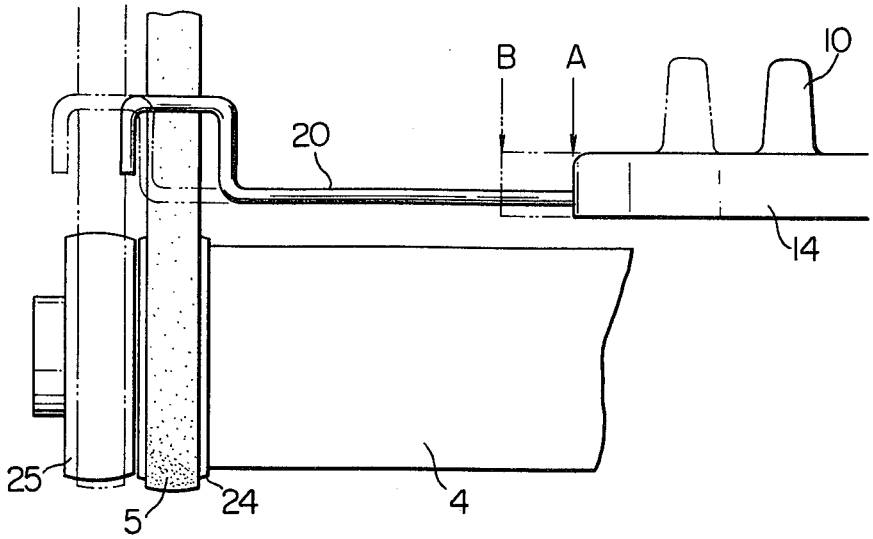
FIG. 7 is a view in explanation of the operation of the belt switching operation of the switching knob shown in FIG. 5.
Figure 8:
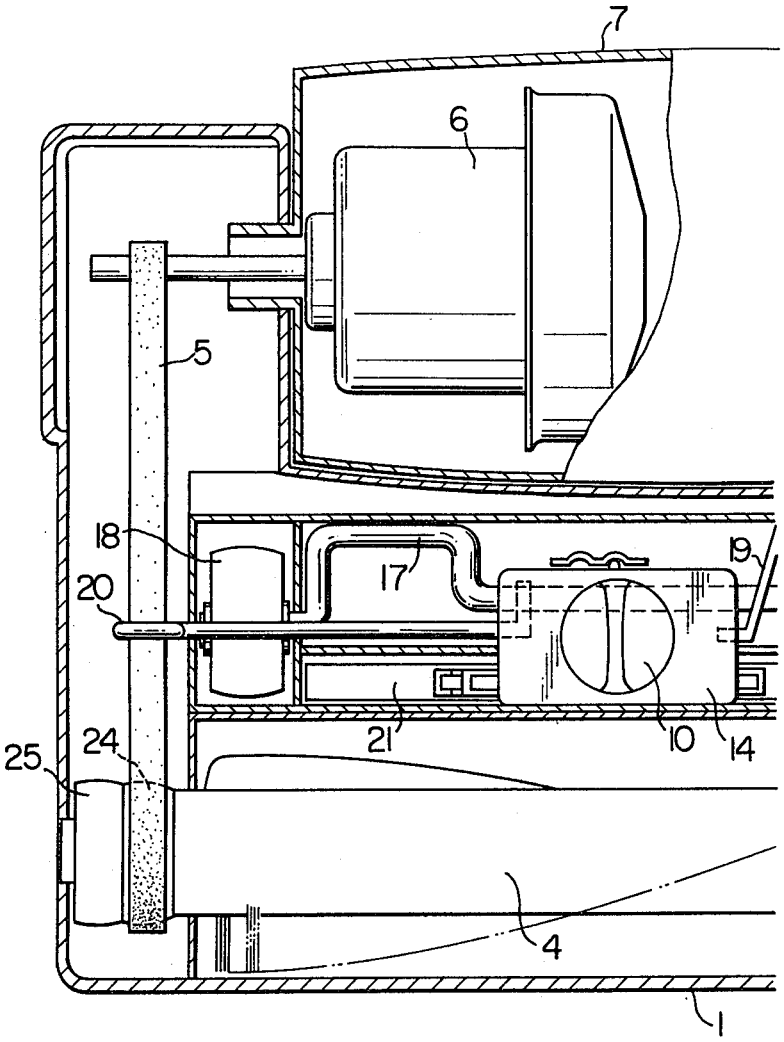
FIG. 8 is a sectional view, on an enlarged scale, of portions of the suction port with certain parts being broken away.

As shown in FIGS. 7 and 8, the suction port body 1 has at its forward end portion the rotary brush 4 provided with a drive pulley 24 and an idling pulley 25, and a belt switching forked arm 20 is operative to switch the belt 5 between the two pulleys 24 and 25 .

Figure 9:
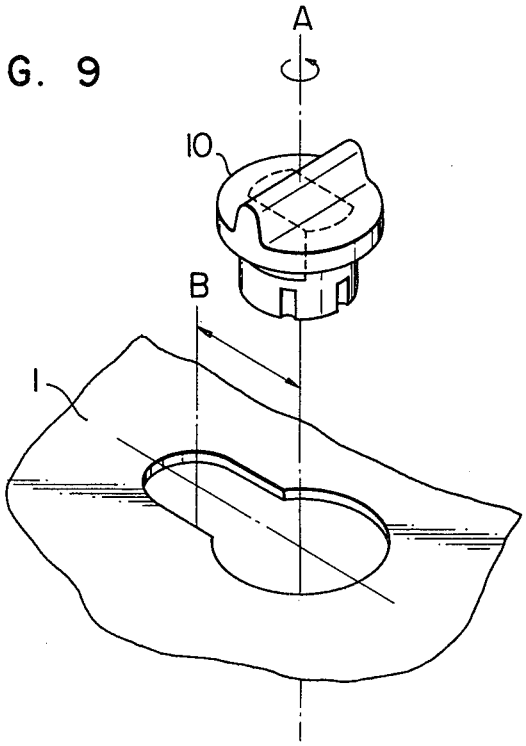
FIG. 9 is a perspective view in explanation of the switching knob in relation to the suction port.

Referring to FIG. 9, the switching knob 10 can be rotated with respect to the suction port body 1 when disposed in position A as indicated by a solid line and cannot be rotated when in position B. The knob 10 has a limited distance for movement in a transverse direction.

The suction port body 1 is formed therein with a dust passage which, as shown in FIG. 1, is communicated with a suction port joint 26 and connected to the main body case 7 via an external hose 27.

The main body case 7 is divided into three spaces which are an electrically operated blower chamber 28, the bag compartment 9 and a cord reel chamber 29.

The electrically operated blower chamber 28 houses the electrically operated blower 6 and is formed with an exhaust port 30, a suction port 31 connected to the bag compartment 9, and an inlet 33 of a main body duct 32 communicating with the cord reel chamber 29. It is formed at the outside with an offset 34 for engaging the axle push-out lever 19 extending from the suction port body 1 side.

Figure 10:
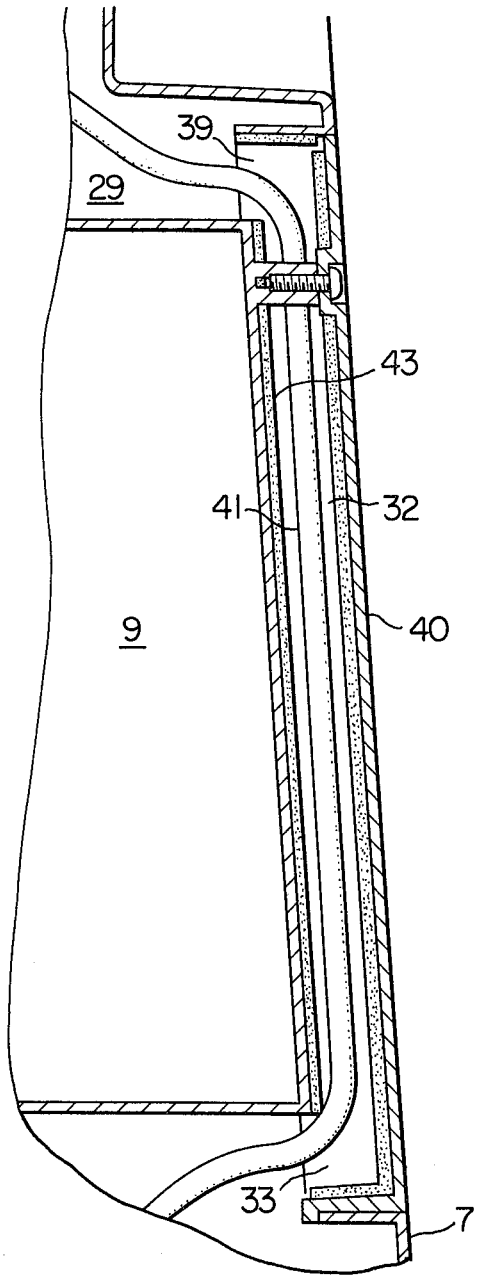
FIG. 10 is a sectional view, on an enlarged scale, of the main body duct portion.

The bag compartment 9 has the external hose 27 connected to its bottom and a mounting base 36 for mounting a filter 35. The cord reel chamber 29 houses therein a cord reel 37 for winding a power source cord 42 thereon, a switch, a cord reel button 38 and a switch button and is formed with an outlet 39 of the main body duct 32. A wire 41 from the cord reel 37 to the electrically operated blower 6 is extended through the main body duct 32 as shown in FIG. 10, and the main body duct 32 is closed by a duct cover 40 from outside.

The duct 32 has attached to its inner wall surface a lining of a sound absorbing material 43 of a thickness of 5–10 mm, such as polyurethane foam, glass fiber, etc., to perform a muffling function.

Operation of the embodiment of the upright type electric cleaner in conformity with the invention is as follows.

In operation, the power source cord 42 is payed out of the cord reel 37 and connected to a household outlet, and the pedal 12 in the rear of the suction port body 1 is depressed to move the main body case 7 in tilting movement from above the suction port body 1.

Then the switch button is pressed to turn it on and actuate the electrically operated blower 6 which draws dust by suction and at the same time actuate the rotary brush 4 through the belt 5.

At this time, when the switching knob 10 is located on a side A shown in FIG. 9 and in a position X of the height setting cam 15 shown in FIG. 6, the belt 5 is trained to the drive pulley 24 as shown in a solid line in FIG. 7 and the amount of the front wheel 18 for height adjustment projecting through the bottom plate 2 of the suction port body 1 is minimized (as indicated by a solid line in FIG. 3), so that the machine suits the cleaning of rugs of short yarn projecting from its surface.

When a rug has long yarn or yarn of a medium length, it is possible to vary the amount of the front wheel 18 for height adjustment projecting through the bottom plate 2 by turning the switching knob 10 to a position Y or Z of the height setting cam 15 shown in FIG. 6, to enable the machine to be ready for handling a rug of any different length of yarn projecting from its surface.

Turning of the switching knob 10 will be described. When the main body case 7 is brought to an upright position on the suction port body 1, the pivotal movement thereof causes the offset 34 on the main body case 7 to press downwardly one end portion of the axle push-out lever 19 projecting outwardly from the suction port body 1, to thereby press downwardly an upper end portion of the height adjusting axle 17 (to a broken line position shown in FIG. 3) until the height adjusting axle 17 reaches a position which is below the lowest position thereof that might be reached when the switching knob 10 only is turned.

When this is the case, the height setting cam 15 is released from the height adjusting axle 17 to enable the switching knob 10 to be turned smoothly with a small force to a desired position because no external force is exerted thereon.

Thereafter, if the main body case 7 is moved in tilting movement again, then the offset 34 moves likewise to render the axle push-out lever 19 free and bring the height setting cam 15 and the crank pin corresponding portion 17-2 of the height adjusting axle 17 to positions in which one is positioned against the other.

When the surface to be cleaned is not a rug but an wooden board or a Japanese tatami or straw-matted floor on which the rotary brush 4 need not be rotated, the switching knob 10 may be moved to a side B as shown in FIGS. 5 and 7.

In this case, the switching knob 10 can be moved to the B side only when it is located in position X shown in FIG. 6 (in which the distance between the surface to be cleaned and the suction port body 1 is minimized). Thus, the switching knob 10 is set in position X before being moved to the B side.

This transfers the belt 5 from the drive pulley 24 to the idling pulley 25 by the action of the belt switching formed arm 20, so that the rotary brush 4 is rendered inoperative and drawing of dust can be continuously performed with the electrically operated blower alone.

If cleaning is carried out in the manner described hereinabove, an air current containing a lot of dust flows through the opening 3 in the bottom plate 2 of the suction port 1 into the duct in the suction port body 1, from which it flows through the external hose 27 into the filter 25 where dust is separated from a clean air current which along passes through the suction port 31 and the electrically operated blower 6. Thus, a part of the clean air current is exhausted outside the machine through the exhaust port 30 and the rest flows from the inlet 33 into the main body duct 32, to be introduced into the cord reel chamber 29. When the air current flows through the main body duct 32, the sound is absorbed by the sound absorbing material 43 attached as a lining to the inner wall surface of the duct 32. The air exhausted cools the power source cord 42, and a contact of the cord reel 37 before being exausted outside the machine. The duct 32 has a substantial length and enables a high sound abosrbing effect to be achieved. The fact that the exhausted air is released from the narrow duct 32 into the cord reel chamber 29 of a wide space is conductive to increased sound absorbing effect to be achieved.

As an example, an electrically operated blower of a current consumption of 550 watt was used as air blowing and drive means, a cabtyre cable of a core of a cross-sectional area of 0.75 $mm^2$ was used as a power source cord, and a framework of $30\times30\times280$ mm having a lining of polyurethane foam applied to its entire inner wall surface was used as a sound absorbing chamber. Experiments conducted under these conditions show results that as compared with the arrangement whereby all the exhaust was ejected through the exhaust port 30, the noise level could be reduced by about 5 phon. The surface temperature of the power source cord was reduced by about 50° C.

It has been ascertained as the result of experiment that the noise level of the prior art of 68 dB (A) is lowered to 64 dB (A), and the temperature of the prior art of 76° C. is lowered to 26° C.

The embodiment of the upright type electrical cleaner in conformity with the invention constructed and operating as described hereinabove can achieve the following effects:

(1) The mechanism for causing the front wheel 18 to project through the suction port when the main body case 7 is brought to an upright position on the suction port body 1 to keep a predetermined distance between the projecting portion of the rotary brush 4 and the surface to be cleaned can be composed of an axle 17 in the form of a crank shaft made by bending a rod, an axle push-out lever 19 connected to the axle and an offset 34 formed in the main body case 7. This feature enables the mechanism of simple construction to be used, thereby permitting reliability of the cleaning machine to be increased, allowing the number of parts to be reduced and contributing to simplification of assembling.

(2) The axle push-out lever 19 is pivotally connected at one end thereof to the suction port body 1 and has a force exerted on the other end thereof as the main body case 7 is pivotally moved to be brought into engagement with the axle 17 substantially at the midpoint on the lever 19 to push the front wheel 18 downwardly. This arrangement reduces the force exerted on the other end of the lever 19 to a relatively low level and facilitates the operation of bringing the main body case 7 to an upright position on the suction port body 1. Thus, the mechanism is light in weight and sturdy in strength and causes no high stress to be produced in the parts associated therewith.

(3) Since one end portion of the axle push-out lever 19 projects outwardly, it is possible to ascertain from outside whether there is any trouble in the mechanism. The projecting one end portion is pressed downwardly by the offset 34 in the lower portion of the main body case 7, thereby enabling the operation to be performed as the main body 1 is brought to an upright position on the suction port body regardless of whether or not the operator has the intention of performing the operation.

(4) The height setting cam 15 and an end portion of the axle 17 can be released from connection with each other while the main body case 7 is kept in an upright position on the suction port body 1, thereby enabling the switching knob 10 to be manipulated with a force of low magnitude.

(5) The mechanism allows the front wheel 18 to be pressed downwardly only when the main body is upright on the suction port body 1. By virtue of this feature, no influence are exerted on the tilting angle of the main body case 7 when the cleaning machine is pushed or pulled while cleaning is being performed in general, thereby permitting a predetermined distance to be kept between the projecting end of the rotary brush 4 and the surface to be cleaned.

(6) When it is desired to perform another work operation by releasing the hand from the cleaning machine while a cleaning operation is being performed, it is possible to bring the rotating rotary brush 4 from contact with the surface being cleaned merely by bringing the main body case 7 to an upright position on the suction port body 1. This eliminates the risk of damaging the surface being cleaned even if the machine is allowed to stand in the same position without turning it off without applying an unnecessary load to the motor.

(7) The noise level of the exhausted air can be greatly reduced and a rise in temperature of the power source cord 42 can be effectively avoided since part of the exhausts released through the blower 6 is led through duct with a lining of sound absorbing material 43 at the back of the bag compartment 9 to the cord reel chamber 29.

While a preferred embodiment of the invention has been described using specific terms, such description is for illustrative purposes only, and it is to be understood that changes and variations may be made without departing from the spirit or scope of the following claims.

What is claimed is:

1. An upright type electric cleaner comprising: a main body case including an upper portion, a middle portion, and a lower portion, a cord reel chamber means disposed in said upper portion of said main body case for receiving a cord winding means, a bag compartment means disposed in said middle portion of said main body case for receiving a dust filter means, a blower chamber means disposed at the lower portion of said main body case for receiving a blower means and a driving means, a suction port body for supporting said main body case thereon for a tilting movement, a sound absorbing duct means disposed in said compartment means in communication with said cord reel chamber means and said blower chamber means for reducing a noise level of the cleaner, and wherein at least a portion of air introduced from said suction port body through said bag compartment means is exhausted from said blower chamber means through said sound absorbing duct means into said cord reel chamber means whereby the air cools the cord reel chamber means.

2. An upright type electric cleaner as claimed in claim 1 wherein said suction port body includes an opening formed at a bottom thereof for drawing dust therethrough by a dust drawing operation section and a rotary brush positioned in said opening for operation by a rotary brush drive section associated with said dust drawing operation section;

a wheel is arranged in said suction port body in a vicinity of said opening for movement in and out of a bottom plate of the suction port body;

an axle supports said wheel for rotation; and means adapted to be brought into contact with a part of said axle when said main body case is brought to a substantially upright position on said suction port body to press said axle downwardly, said means being brought into engagement with a lower end portion of said main body case.

3. An upright type electric cleaner as claimed in claim 1 wherein said main body case has an offset at a lower end portion thereof;

said suction portion body comprises an opening formed at a bottom thereof for drawing dust therethrough by a dust drawing operation section;

a rotary brush positioned in said opening for operation by a rotary brush drive section associated with said dust drawing operation section;

a wheel arranged in said suction port body in the vicinity of said opening for movement in and out of a bottom plate of the suction port body; an axle in said suction body for supporting said wheel for rotation; and an axle push-out lever positioned against a part of said axle, said axle push-out lever being supported at one end portion thereof and projecting outwardly of the suction port body at the other end portion thereof and extending to a lower end of said main body case, so that when said main body case is substantially upright on said suction port body said offset of said main body case presses against said axle push-out lever to cause the wheel to move downwardly from the bottom plate of said suction port body.

4. An upright electric cleaning machine as claimed in claim 3 wherein said axle is in the form of a crank shaft shaped like a letter V as viewed axially thereof and includes an axle portion located at the bottom of the letter V pivotally connected to the suction port body and axle portions located at free ends of the letter V, one of said axle portions being connected to said wheel and the other axle portion contacting with the substantially central portion of said axle push-out lever.

5. An upright type electric cleaning machine as claimed in claim 1 wherein said suction port body has an opening formed at a bottom thereof for drawing dust therethrough by a dust drawing operation section and a rotary brush positioned in said opening for operation by a rotary brush drive section associated with said dust drawing operation section, said suction port body including a wheel located in a vicinity of said opening for movement in and out of a bottom plate of the suction port body; a drive pulley and an idling pulley are arranged in parallel and connected to said rotary brush connected in turn through a belt to said rotary brush drive section; a belt switching forked arm for holding said belt between branches thereof; an axle supporting said wheel for adjusting the height of said wheel; a height setting cam rotatably supported and positioned against said axle for adjusting a height of the wheel; and a switching knob supported in a slide base and extending outwardly of the suction port body, whereby said belt switching forked arm and said height setting cam can be actuated by manipulating the same switching knob.

* * * * *